US009970121B2

(12) United States Patent
Ochi et al.

(10) Patent No.: US 9,970,121 B2
(45) Date of Patent: May 15, 2018

(54) COMPOSITE MATERIAL, METHOD FOR FORMING THE COMPOSITE MATERIAL, ELECTRODE PLATED WITH THE COMPOSITE MATERIAL, AND CONNECTION STRUCTURE HAVING THE COMPOSITE MATERIAL

(71) Applicant: DENSO CORPORATION, Kariya, Aichi-pref. (JP)

(72) Inventors: Kenji Ochi, Kariya (JP); Toshihiro Miyake, Kariya (JP); Yasuo Ishihara, Kariya (JP)

(73) Assignee: DENSO CORPORATION, Kariya (JP)

( * ) Notice: Subject to any disclaimer, the term of this patent is extended or adjusted under 35 U.S.C. 154(b) by 37 days.

(21) Appl. No.: 14/982,048

(22) Filed: Dec. 29, 2015

(65) Prior Publication Data

US 2016/0201211 A1 Jul. 14, 2016

(30) Foreign Application Priority Data

Jan. 8, 2015 (JP) ..... 2015-2444

(51) Int. Cl.

| | |
|---|---|
| ***C25D 9/02*** | (2006.01) |
| ***C25D 3/12*** | (2006.01) |
| ***C25D 3/22*** | (2006.01) |
| ***C25D 3/38*** | (2006.01) |
| ***C25D 3/56*** | (2006.01) |
| ***C25D 5/00*** | (2006.01) |

(Continued)

(52) U.S. Cl.

CPC ..... *C25D 9/02* (2013.01); *C25D 3/12* (2013.01); *C25D 3/22* (2013.01); *C25D 3/38* (2013.01); *C25D 3/56* (2013.01); *C25D 5/00* (2013.01); *C25D 7/00* (2013.01); *C25D 15/00* (2013.01); *H01R 13/03* (2013.01)

(58) Field of Classification Search

CPC ..... G01N 27/403–27/419; C25D 7/00; C25D 9/02; H01R 13/03

See application file for complete search history.

(56) References Cited

U.S. PATENT DOCUMENTS

2003/0159938 A1 8/2003 Hradil
2004/0137162 A1* 7/2004 Kikui ..... C23C 18/38 427/443.1

(Continued)

FOREIGN PATENT DOCUMENTS

JP 2008-240902 A 10/2008
JP 2014-065949 A 4/2014

OTHER PUBLICATIONS

Leventis et al. (N. Leventis, X. Gao, Nd—Fe—B Permanent Magnet Electrodes. Theoretical evaluation and experimental demonstration of the paramagnetic body forces, J. Am. Chem. Soc. 124(6) (2002) 1079-1088.*

*Primary Examiner* — Susan D Leong
*Assistant Examiner* — Joshua L Allen
(74) *Attorney, Agent, or Firm* — Posz Law Group, PLC

(57) ABSTRACT

A composite material includes a metal material having conductivity and an oxidation inhibitor mixed with the metal material. The oxidation inhibitor forms a complex with the metal material to exert a resistance to oxidation of the metal material. For example, the composite material is formed on a surface of a base material as a plating material. As another example, the composite material is plated on a surface of an electrode.

13 Claims, 8 Drawing Sheets

(51) Int. Cl.

| | |
|---|---|
| ***C25D 7/00*** | (2006.01) |
| ***C25D 15/00*** | (2006.01) |
| ***H01R 13/03*** | (2006.01) |

(56) References Cited

U.S. PATENT DOCUMENTS

| | | | | |
|---|---|---|---|---|
| 2004/0149587 | A1 | 8/2004 | Hradil | |
| 2004/0181114 | A1* | 9/2004 | Hainfeld | A61K 41/0038 600/1 |
| 2008/0230394 | A1* | 9/2008 | Inbe | C23C 22/34 205/241 |
| 2008/0237065 | A1* | 10/2008 | Kimata | G01N 27/4067 205/794.5 |
| 2013/0081855 | A1* | 4/2013 | Miyake | H01R 13/03 174/126.2 |
| 2014/0045061 | A1* | 2/2014 | Suzuki | C25D 3/58 429/211 |
| 2017/0012377 | A1 | 1/2017 | Ochi | |

* cited by examiner

COMPOSITE MATERIAL, METHOD FOR FORMING THE COMPOSITE MATERIAL, ELECTRODE PLATED WITH THE COMPOSITE MATERIAL, AND CONNECTION STRUCTURE HAVING THE COMPOSITE MATERIAL

CROSS REFERENCE TO RELATED APPLICATION

This application is based on Japanese Patent Application No. 2015-2444 filed on Jan. 8, 2015, the disclosure of which is incorporated herein by reference.

TECHNICAL FIELD

The present disclosure relates to a composite material containing a metal material, a method for forming the composite material, an electrode plated with the composite material, and a connection structure having the composite material.

BACKGROUND

A composite material including a metal matrix and a reducing agent dispersed in the metal matrix has been known, for example, as disclosed in JP 2013-79429 A, which corresponds to US 2013/0081855 A1. The composite material forms an electrode of an electric contact and a film on an electric contact.

SUMMARY

The electric contact film made of the composite material of JP 2013-79429 A can be employed as a plating film of a surface electrode formed on a surface of a substrate. For example, a terminal electrode having resiliency is pressed against the surface electrode due to its reaction force to ensure electric conduction between the terminal electrode and the surface electrode.

The terminal electrode and the surface electrode repeatedly expand and contract according to a change of ambient temperature when in use, and finely slide with each other. When heat and stress occurs in a contact point between the electric contact film plating the surface electrode and the terminal electrode due to the fine sliding, the metal material in a surface layer of the electric contact film is oxidized, resulting in degradation of the conductivity. However, the electric contact film contains the reducing agent dispersed in the metal matrix. Therefore, even if the metal material is oxidized, the reducing agent causes an oxidation-reduction reaction to reduce the oxidized metal material to the original metal material. As such, the degradation of the conductivity is restricted.

In fact, the amount of the reducing agent existing in the surface layer of the electric contact film is limited. After the reducing agent existing in the surface layer is fully used for the oxidation-reduction reaction, the oxidation of the metal material progresses, resulting in the degradation of the conductivity. When the composite material forming the surface layer of the electric contact film is worn due to the fine sliding, the reducing agent, which has not been contributed to the oxidation-reduction reaction, newly exposes on the surface layer. Accordingly, the degradation of the conductivity is restricted by the oxidation-reduction reaction by the reducing agent newly exposing on the surface layer. Also in such a case, however, after the reducing agent newly exposing on the surface layer is fully used for the oxidation-reduction reaction, the oxidation of the metal material ultimately progresses, resulting in the degradation of the conductivity. As such, the conductivity of the electric contact film is likely to change due to the fine sliding.

It is an object of the present disclosure to provide a composite material which is capable of restricting the change in conductivity due to fine sliding, a method for forming the composite material, an electrode plated with the composite material, and a connection structure having the composite material.

According to an aspect of the present disclosure, a composite material includes a metal material having conductivity and an oxidation inhibitor that forms a complex with the metal material to exert a resistance to oxidation of the metal material.

For example, the composite material is employed as a plating material. The composite material is formed on a surface of a base material as the plating material.

For example, a method for forming the composite material as a plating material on a surface of a base material includes: immersing the base material in a mixture containing metal atoms of the metal material and oxidation inhibitor molecules of the oxidation inhibitor; and applying a voltage to the base material and the mixture so that the metal material and the oxidation inhibitor molecules are eutectoid on the surface of the base material, to thereby form the composite material on the surface of the base material.

For example, the composite material is employed in a connection structure. The composite material is formed on a surface of at least one of a first electrode and a second electrode, which form electric connection in the connection structure.

For example, the composite material is employed in a surface layer of at least one of electrodes. In such a case, an effect of oxidation inhibitor will not be reduced according to fine sliding between the electrodes, differently from a structure in which a reducing agent is dispersed in a metal matrix to reduce a metal material with the reducing agent. Also, the oxidation inhibition of the metal material will not be limited. As a result, it is less likely that the conductivity of the composite material will be changed, i.e., reduced due to the fine sliding.

BRIEF DESCRIPTION OF THE DRAWINGS

The above and other objects, features and advantages of the present disclosure will become more apparent from the following detailed description made with reference to the accompanying drawings, in which like parts are designated by like reference numbers and in which.

DETAILED DESCRIPTION

Figure 1:
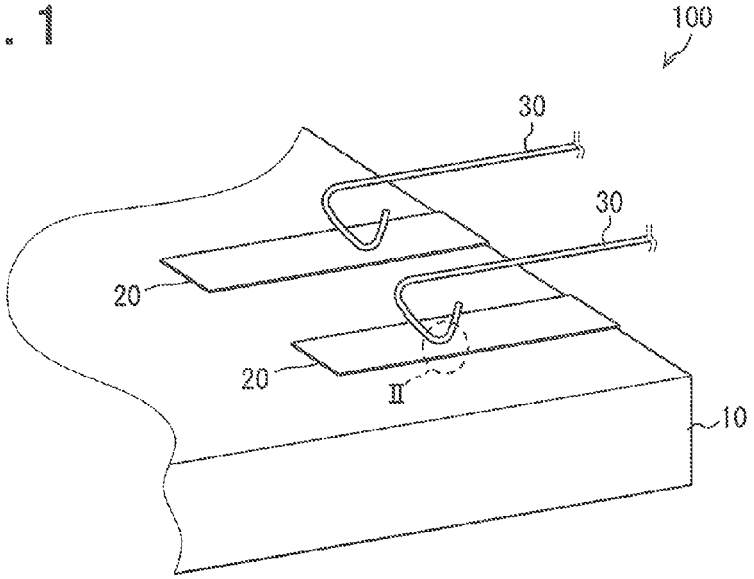
FIG. 1 is a perspective view of a part of an electronic device according to an embodiment of the present disclosure.

In an embodiment, a composite material includes a metal material having conductivity and an oxidation inhibitor that forms a complex with the metal material to exert a resistance to oxidation of the metal material. In a case where the composite material is employed in a surface layer of at least one of electrodes, an effect of oxidation inhibitor will not be reduced according to fine sliding between the electrodes, differently from a structure in which a reducing agent is dispersed in a metal matrix to reduce a metal material with the reducing agent. Also, the oxidation inhibition of the metal material will not be limited. As a result, it is less likely that the conductivity of the composite material will be changed, i.e., reduced due to the fine sliding.

For example, the oxidation inhibitor is selected from chemical species that improve an activation energy of oxidation when forming the complex with the metal material to be higher than that of a simple substance of the metal material, thereby to exert the resistance to oxidation.

For example, the metal material includes a plurality of metal atoms, and the oxidation inhibitor includes a plurality of oxidation inhibitor molecules. A metal bonding between the metal atoms and a coordinate bonding between the metal atom and the oxidation inhibitor molecule are stronger than an intermolecular interaction between the oxidation inhibitor molecules.

In such a case, the intermolecular interaction between the oxidation inhibitor molecules is likely to be easily separated than the metal bonding between the metal atoms and the coordinate bonding between the metal atom and the oxidation inhibitor molecule, when the composite material is stressed. Therefore, even if a part of the composite material is worn due to the stress of the composite material, the metal atoms of the worn part of the composite material are still bonded with the oxidation inhibitor molecules. As a result, the oxidation of the metal atoms contained in the worn part is restricted by the oxidation inhibitor molecule, and the degradation of the conductivity is reduced. For example, even if the worn part of the composite material is interposed between electrodes, which form electric connection, the degradation of the conductivity between the electrodes can be restricted.

For example, the metal atoms are bonded to form a metal mass. The oxidation inhibitor molecules are bonded to the metal mass to surround the metal mass. Each of a plurality of unit components is made of the metal mass and the oxidation inhibitor molecules bonded to the metal mass, and the plurality of unit components are uniformly distributed in the composite material. In such a case, the surface layer of the worn part is made of the oxidation inhibitor molecules. Therefore, as compared with a case where the metal atoms are located in the surface layer, it is less likely that the metal atoms of the metal mass will come close to oxygen molecules, and thus oxidation of the metal atoms of the metal mass is restricted.

Hereinafter, embodiments of the present disclosure will be described more in detail with reference to the drawings. In the embodiments, a composite material is exemplarily employed to a plating material for an electrode of an electronic device.

An electronic device 100 according to an embodiment will be described with reference to FIGS. 1 to 11.

As shown in FIG. 1, the electronic device 100 includes a substrate 10, surface electrodes 20, and terminal electrodes 30. The substrate 10 is made of an insulating material. The surface electrodes 20 are formed on a surface of the substrate 10. The terminal electrodes 30 are components of a card edge connector. The terminal electrodes 30 have resiliency. A part of each of the terminal electrodes 30 is pressed against the corresponding surface electrode 20 due to the reaction force of the terminal electrode 30, thereby to ensure an electric conduction between the terminal electrode 30 and the surface electrode 20.

The terminal electrode 30 is electrically connected to a wire harness, for example. The surface electrode 20 is electrically connected to a wire that is formed on the surface of the substrate 10 or inside of the substrate 10. For example, the surface electrode 20 corresponds to a first electrode, and the terminal electrode 30 corresponds to a second electrode. The electronic device 100 includes a connection structure.

Figure 2:
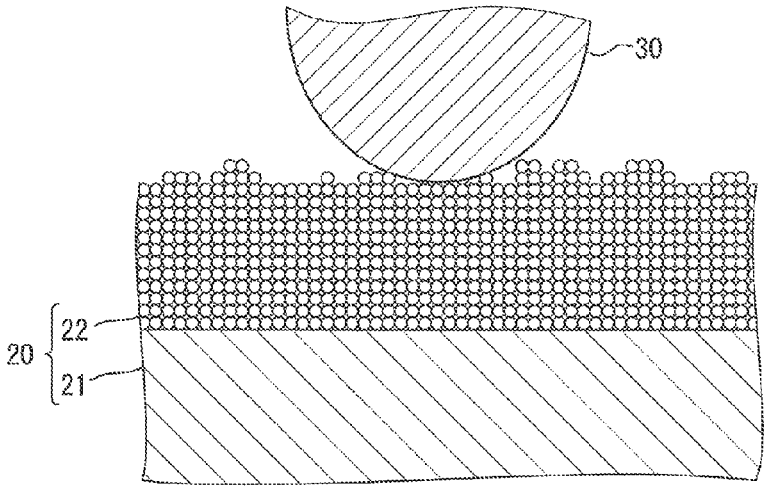
FIG. 2 is an enlarged cross-sectional view of a part II shown in FIG. 1.
Figure 11:
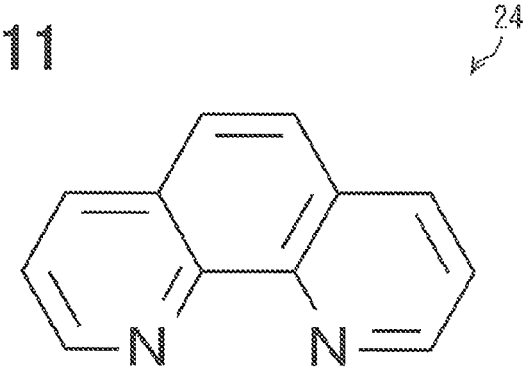
FIG. 11 is a diagram illustrating a chemical formula of 1,10-phenanthroline.
Figure 12:
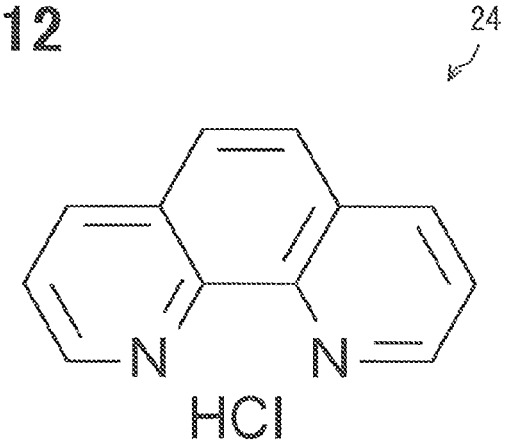
FIG. 12 is a diagram illustrating a chemical formula of 1,10-phenanthroline hydrochloride.
Figure 13:
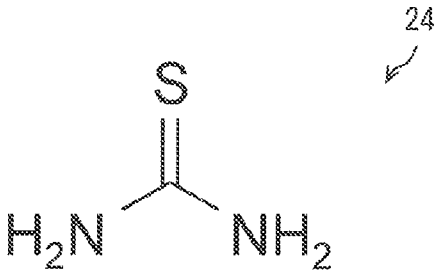
FIG. 13 is a diagram illustrating a chemical formula of thiourea.
Figure 14:
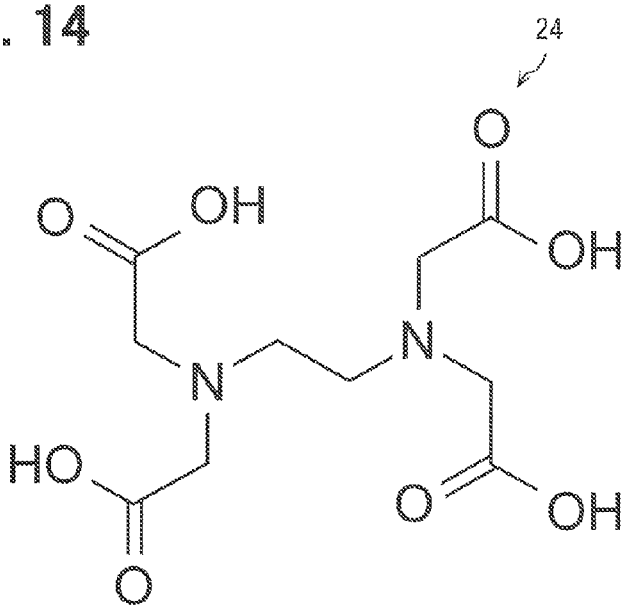
FIG. 14 is a diagram illustrating a chemical formula of ethylenediaminetetraacetic acid.

As shown in FIG. 2, the surface electrode 20 includes a base material 21 and a plating 22 covering the surface of the base material 21. The base material 21 is made of stainless steel (SUS), copper (Cu), or an alloy having conductivity. The plating 22 is made of a metal material and an oxidation inhibitor mixed in the metal material. As shown in FIG. 3, the metal material of the plating 22 is provided by a mass of metal atoms 23 (hereinafter referred to as the metal mass). The metal mass is made of copper. The oxidation inhibitor includes oxidation inhibitor molecules. The oxidation inhibitor molecule is 1,10-phenanthroline, as shown in FIG. 11. The plating 22 corresponds to a composite material. The base material 21 corresponds to a plated material to be plated or coated.

Figure 3A:
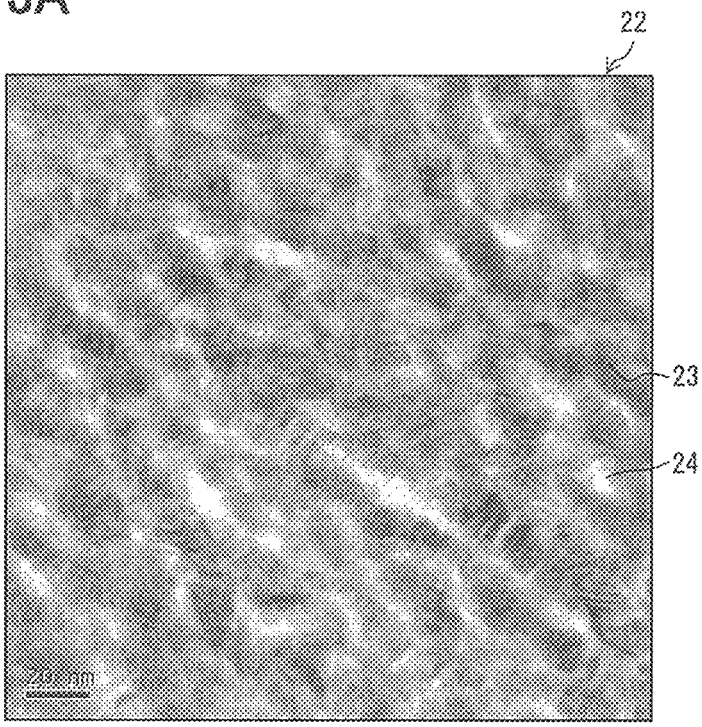
FIG. 3A is a diagram showing a SEM image of a plating according to the embodiment.
Figure 3B:
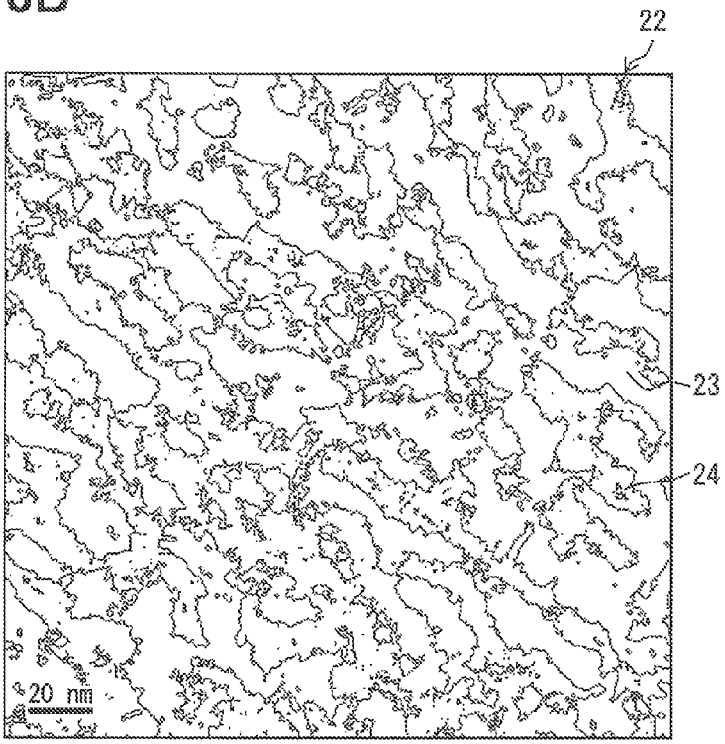
FIG. 3B is a line diagram of the SEM image shown in FIG. 3A.

FIG. 3A shows a SEM image of the plating 22 taken through a scanning transmission electron microscope by the inventors, and FIG. 3B is a line diagram of the SEM image shown in FIG. 3A. In FIG. 3A, black areas indicate the metal atoms 23 (Cu), and white areas indicate carbon atoms (C) contained in the oxidation inhibitor molecules 24. Further, gray areas indicate overlapping portions of the metal atoms 23 and the oxidation inhibitor molecules 24. As it can be appreciated from FIG. 3A, the plating 22 is made of the metal atoms 23 and the oxidation inhibitor molecules 24 that are uniformly mixed to each other.

Figure 4:
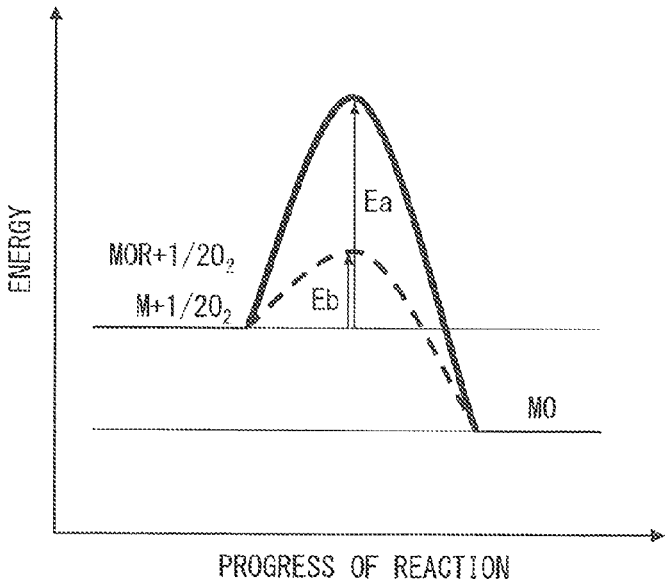
FIG. 4 is a graph schematically illustrating an activation energy of oxidation.

FIG. 4 is a graph illustrating an activation energy of oxidation. In FIG. 4, M indicates the metal atom 23, and OR indicates the oxidation inhibitor molecule 24. In the following, for the purpose of easing the description, it is assumed that a simple substance M of the metal atom 23 (hereinafter also referred to as a simple substance metal M), and a molecule MOR made of the metal atom 23 and the oxidation inhibitor molecule 24 bonded with the metal atom 23 have the same ground level. In FIG. 4, a solid line Ea represents an activation energy of the metal atom 23 contained in the molecule MOR, and a dashed line Eb represents an activation energy of the simple substance metal M.

As shown in FIG. 4, the activation energy Ea of the metal atom 23 contained in the molecule MOR is higher than the activation energy Eb of the simple substance metal M, and the metal atom 23 contained in the molecule MOR is less oxidized than the simple substance metal M.

Figure 5:
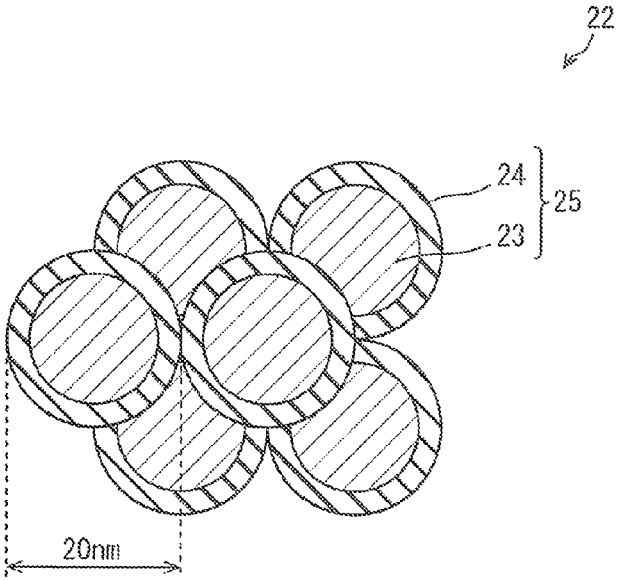
FIG. 5 is a diagram schematically illustrating a bonding state of unit components of the plating.

FIG. 5 schematically illustrates unit components 25 forming the plating 22. As shown in FIG. 5, the unit component 25 is made of the mass of the metal atoms 23 (metal mass) surrounded by the oxidation inhibitor molecules 24. The metal mass is made of a plurality of metal atoms 23 bonded to each other. The oxidation inhibitor molecules 24 are bonded to the surface of the metal mass to surround the periphery of the metal mass.

The plurality of metal atoms 23 are bonded to each other by mutual interaction between them, and the metal atoms 23 and the oxidation inhibitor molecules 24 are bonded to each other by mutual interaction between them. The metal atoms 23 are boned to each other through a metallic bonding. The metal atom 23 and the oxidation inhibitor molecule 24 are bonded to each other through a coordinate bonding or an electrostatic interaction.

As shown in FIG. 5, a plurality of the unit components 25 are uniformly distributed and bonded to each other, to thereby form the plating 22. As described above, the surface layer of the unit component 25 is provided by the oxidation inhibitor molecules 24. Therefore, the plurality of the unit components 25 are bonded to each other through the mutual interaction between the oxidation inhibitor molecules 24.

The bonding between the oxidation inhibitor molecules 24 is made by an intermolecular interaction, such as Van der Waals' force. The intermolecular interaction is weaker than each of the metal bonding and the coordinate bonding. Therefore, the bonding between the unit components 25 is easily separated due to the stress applied to the plating 22.

If a part of the plating 22 is worn due to the stress applied, the part worn (hereinafter referred to as the abrasion powder) is likely to be made of the unit components 25, and the surface of the part is likely to be covered with the oxidation inhibitor molecules 24.

Figure 6:
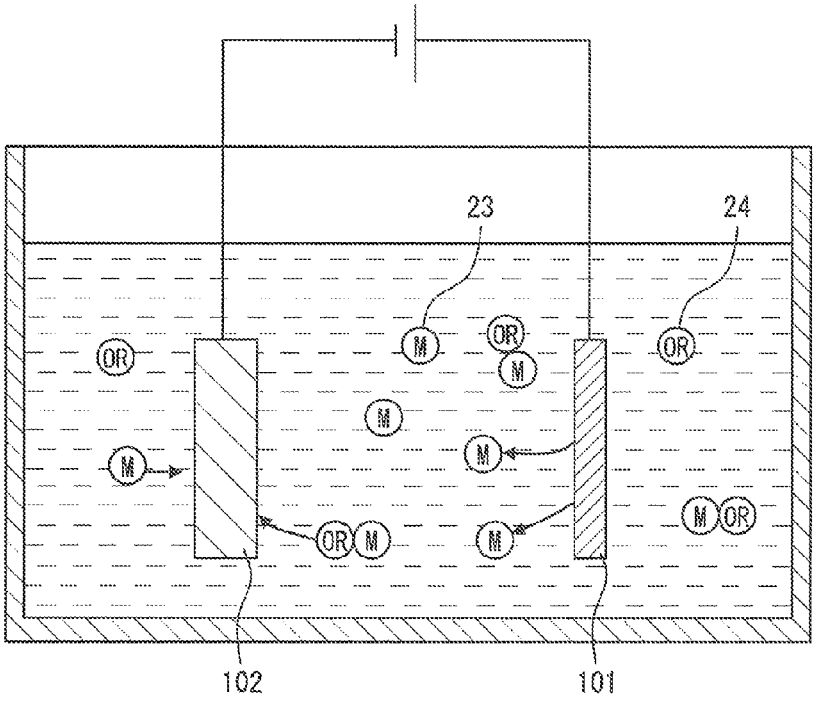
FIG. 6 is a diagram for explaining a production method of the plating.

Next, a method of forming the plating 22 will be described with reference to FIGS. 6 to 8. In FIG. 6, M represents an ionized metal atom 23, and OR represents an ionized oxidation inhibitor molecule 24.

Firstly, a solution (mixture) in which the metal atoms 23 and the oxidation inhibitor molecules 24 are mixed is prepared. In the mixture, the metal atoms 23 and the oxidation inhibitor molecules 24 exist as ions, or as molecules MOR, which are complexes made by coordinate bonding of the oxidation inhibitor molecules 24 and the metal atoms 23.

In the mixture, a positive electrode 101 and a negative electrode 102 are inserted, and are applied with voltage. The electrode 101 serving as an anode is made of the same material as the metal atom 23 (e.g., copper), and the electrode 102 serving as a cathode contains the base material 21.

When the voltage is applied between the positive electrode 101 and the negative electrode 102, the ionized metal atoms 23 and oxidation inhibitor molecules 24, and the molecules MOR are attracted to the negative electrode 102 (base material 21), and form eutectoid on the surface of the negative electrode 102. As a result, the plating 22 is formed on the surface of the base material 21.

The positive electrode 101 is not limited to the example described above. For example, the positive electrode 101 may be provided by an insoluble anode, such as by platinum (Pt) or graphite (C).

Figure 7:
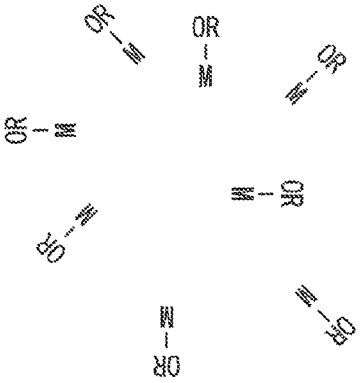
FIG. 7 is a diagram schematically illustrating a bonding process of molecules each made of a metal atom and an oxidation inhibitor molecule bonded with the metal atom.
Figure 8:
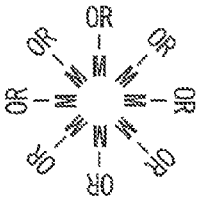
FIG. 8 is a diagram schematically illustrating the unit component made by the bonding of the molecules shown in FIG. 7.

FIG. 7 and FIG. 8 schematically illustrate the formation of the unit component 25. When a number of molecules MOR, each made of the ionized metal atom 23 and the ionized oxidation inhibitor molecule 24 bonded through the coordinate bonding, are attracted to the negative electrode 102, and come close to each other, the metal atoms 23 contained in the molecules MOR are attracted to each other. As a result, the metal atoms 23 are bonded to each other, to thereby form the metal mass. Also, the unit component 25 having the metal mass and the oxidation inhibitor molecules 24 existing on the surface layer of the metal mass is formed.

Specifically, the plating 22 does not necessarily contain only the unit components 25. The plating 22 may include a structure in which the oxidation inhibitor molecules 24 are contained inside of the metal mass of the unit component 25, or a structure in which the metal atoms 23 are partly contained in the surface layer of the unit component 25. Since the plating 22 is mainly made of the unit components 25, the formation of the unit component 25 is schematically illustrated as a main component.

Figure 9:
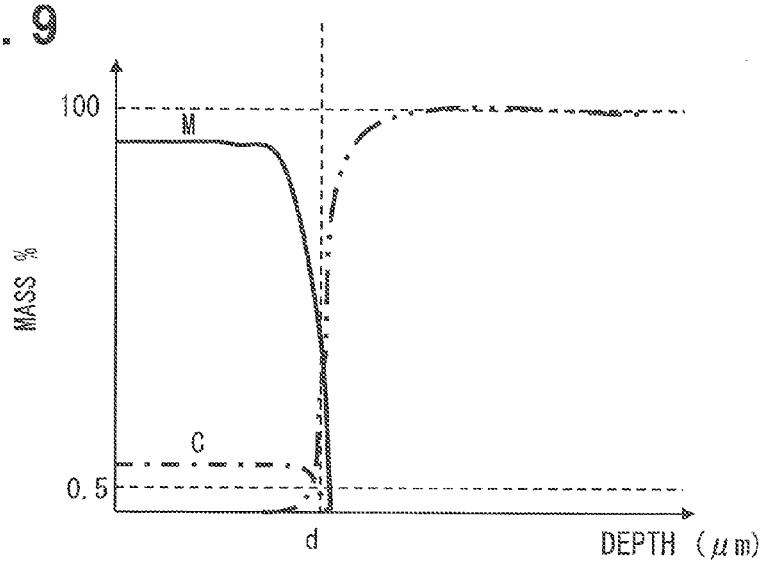
FIG. 9 is a graph illustrating a relationship between a mass percentage of each component element of a surface electrode and depth from the surface of the plating.

FIG. 9 is a graph illustrating the mass percentage of atoms contained in the surface electrode 20 with respect to the depth from the surface of the plating 22 toward a deeper position of the base material 21, which was observed by the inventors. In FIG. 9, a solid line represents the metal atoms 23 contained in the plating 22, and a single-dashed chain line represents the carbon atoms of the oxidation inhibitor molecules 24 contained in the plating 22. Further, a double-dashed chain line represents the metal atoms forming the base material 21.

In FIG. 9, in the proximity of the depth d, which is the boundary between the plating 22 and the base material 21, the plating 22 and the base material 21 both exist. In an area that is not deeper than the proximity of the depth d, only the plating 22 exists, and the metal atoms 23 and the carbon atoms of the oxidation inhibitor molecules 24, which form the plating 22, exist at the constant amounts, respectively. In an area deeper than the proximity of the depth d, only the base material 21 exists, and the mass percentage is 100%.

In the electronic device 100, as described above, as the part of the terminal electrode 30 is pressed against the surface electrode 20 due to the reaction force of the terminal electrode 30, the electric conduction between the terminal electrode 30 and the surface electrode 20 is ensured. The terminal electrode 30 and the surface electrode 20 repeatedly expand and contract according to a temperature change in an environment when in use, and finely slide relative to each other. When heat and stress are caused at the contact point between the plating 22 of the surface electrode 20 and the terminal electrode 30 due to the fine sliding, the metal atoms 23 in the surface layer of the plating 22 are oxidized, resulting in degradation of conductivity.

As shown in FIG. 5 and FIG. 8, in the case where the surface layer of the unit component 25 of the plating 22 is coated with the oxidation inhibitor molecules 24, durability against the sliding improves. When the mass percentage of the oxidation inhibitor molecules 24 of the plating 22 is reduced, the amount of incomplete unit components in which the part of the surface layer of the unit component 25 is not coated with the oxidation inhibitor molecules 24 increases, and the metal atoms 23 are likely to be easily oxidized. As a result, the conductivity of the plating 22 is likely to be easily degraded. On the contrary, when the mass percentage of the oxidation inhibitor molecules 24 contained the plating 22 is increased, the amount of the metal atoms 23 is reduced, resulting in the degradation of the conductivity of the plating 22. In order to keep the conductivity of the plating 22 relative to the fine sliding at a predetermined value, it is necessary to estimate an optimum mass percentage of the oxidation inhibitor molecules 24 contained in the plating 22.

Figure 10:
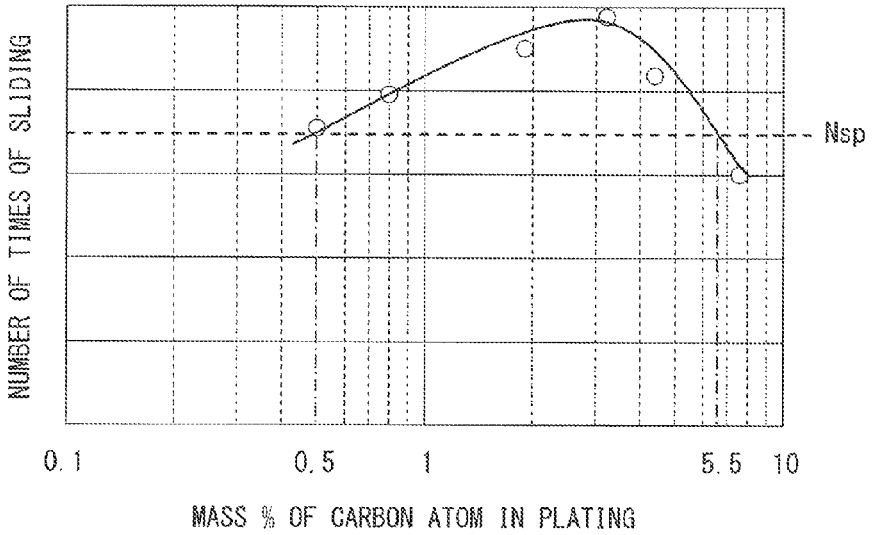
FIG. 10 is a graph illustrating a relationship between a mass percentage of carbon atoms of the oxidation inhibitor molecules of the plating and the number of times of sliding.

FIG. 10 is a graph illustrating an experimental result associated with the mass percentage of the oxidation inhibitor molecules 24. In FIG. 10, a vertical axis represents the number of times of sliding, and a horizontal axis represents a mass percentage of the carbon atoms C of the oxidation inhibitor molecules 24 when the mass percentage of all elements forming the plating 22 is defined as 100. A dashed line Nsp represents a specified number of times of sliding, which indicates quality assurance specified by the inventors.

As shown in FIG. 10, the durability of the plating 22 with respect to the number of times of sliding, that is, the retention of the conductivity (hardness of the degradation of the conductivity) increases as the mass percentage of the carbon atoms C increases approximately from 0.5 to 2.2, and reduces as the mass percentage of the carbon atoms C increases from 2.2 to a higher percentage.

When the mass percentage of the carbon atoms C is approximately equal to or greater than 0.5 and equal to or less than 5.5, the number of times of sliding exceeds the specified number of times of sliding. In the present embodiment, when the mass percentage of the carbon atoms C is 2.2, the durability is the highest. In this case, the diameter of the unit component 25 is approximately 20 nm, as shown in FIG. 5. When the mass percentage of the carbon atom is 0.5, the diameter of the unit component 25 is approximately 50 nm. The size of the unit component 25 reduces as the mass percentage of the carbon atoms of the oxidation inhibitor molecules 24 increases.

Next, advantageous effects of the electronic device 100 according to the present embodiment will be described.

The plating 22 is made of mixture of the metal atoms 23 and the oxidation inhibitor molecules 24, as described above. The activation energy Ea of the metal atom 23 of the molecule MOR, which is made of the metal atom 23 and the oxidation inhibitor molecule 24 bonded with each other, is higher than the activation energy Eb of the simple substance metal M, and is less oxidized than the simple substance metal M. Differently from a case in which the reducing agent is dispersed in the metal matrix to reduce the metal material, the effect of oxidation inhibition of the oxidation inhibitor molecule 24 is not reduced by the fine sliding, and the oxidation inhibition of the metal material is not limited. Therefore, it is less likely that the conductivity of the plating 22 will be changed (reduced) by the fine sliding in the electronic device 100.

The intermolecular interaction between the oxidation inhibitor molecules 24 is weaker than the metal bonding between the metal atoms 23, and the coordinate bonding between the metal atom 23 and the oxidation inhibitor molecule 24. Therefore, the intermolecular interaction of the oxidation inhibitor molecules 24 exerted between the unit components 25 is likely to be easily separated due to the stress applied to the plating 22. When the part of the plating 22 is worn due to the stress, the metal atoms 23 contained in the part worn (abrasion powder) are still bonded with the oxidation inhibitor molecules 24. Therefore, the oxidation of the metal atoms 23 contained in the abrasion powder is restricted by the oxidation inhibitor molecules 24, and the degradation of the conductivity is restricted. Accordingly, even if the abrasion powder is interposed between the terminal electrode 30 and the surface electrode 20, it is less likely that the conductivity between the terminal electrode 30 and the surface electrode 20 will be reduced.

In the unit component 25 of the plating 22, the oxidation inhibitor molecules 24 are bonded to the surface of the metal mass, which is made by the plurality of the metal atoms 23 bonded to each other, to cover the periphery of the metal mass. The plating 22 is formed by the plurality of the unit components 25 uniformly distributed. In this case, the abrasion powder, which is made due to the plating 22 being stressed, is likely to be made only by the unit components 25, and the surface layer of the abrasion powder is likely to be made only by the oxidation inhibitor molecules 24. Therefore, as compared with the structure where the metal material is likely to easily exist in the surface layer of the unit component, it is less likely that the metal atoms 23 forming the metal mass will come close to the oxygen molecules. As such, the oxidation of the metal atoms 23 forming the metal mass is restricted.

The mass percentage of the carbon atoms of the oxidation inhibitor molecules 24 contained in the plating 22 is in the range from 0.5 to 5.5 of the mass percentage of the plating 22. In such a case, since the durability of the plating 22 exceeds the specified number of times of the sliding (hardness of the degradation of the conductivity) shown in FIG. 10, the quality assurance of the plating 22 is ensured. In the present embodiment, the mass percentage of the carbon atoms of the oxidation inhibitor molecules 24 is 2.2. In such a case, the durability against the sliding is the highest.

The embodiment of the present disclosure is described hereinabove. The present disclosure is not limited to the embodiment described hereinabove, but may be implemented in various other ways without departing from the gist of the present disclosure.

In the embodiment described above, the plating 22 is employed as the plating film covering the base material 21 of the surface electrode 20 of the electronic device 100. As another example, the plating 22 may be employed to the terminal electrode 30. Namely, the terminal electrode 30 may be coated with the plating 22. As further another example, the base material 21 and the terminal electrode 30 may be respectively coated with the plating 22.

Moreover, the plating 22 of the embodiment may be employed to any electric devices which need to reduce the oxidation of a metal material. For example, the plating 22 may be employed to a press-fitting portion or member connecting between a circuit board and an eternal terminal. The plating 22 may be suitably employed in in-vehicle devices which are subjected to fine sliding caused by the temperature change from −40 degrees Celsius to 150 degree Celsius according to the ambient temperature and driving of an engine.

In the embodiment described above, 1,10-phenanthroline shown in FIG. 11 is exemplarily employed as the oxidation inhibitor molecule 24 forming the oxidation inhibitor. However, the oxidation inhibitor molecule 24 is not limited to 1,10-phenanthroline. As examples of the oxidation inhibitor molecule 24, as shown in FIGS. 12 to 14, 1,10-phenanthroline hydrochloride, thiourea, and ethylenediaminetetraacetic acid may be employed. Furthermore, the oxidation inhibitor molecule 24 may be provided by at least two of 1,10-phenanthroline, 1,10-phenanthroline hydrochloride, thiourea, and ethylenediaminetetraacetic acid. The oxidation inhibitor (oxidation inhibitor molecule 24) may be provided by any chemical species that can exert oxidation resistance of the metal material by forming complex with the metal material.

In the embodiment described above, copper is exemplarily employed as the metal atom 23 forming the metal material. The metal atom 23 is not limited to copper, but may be tin (Sn), nickel (Ni), an alloy containing tin or nickel as a main component, an alloy containing copper as a main component, or the like. Namely, as the metal atom 23, a metal the conductivity of which reduces when being oxidized may be employed.

In the above description of the production methods of the plating with reference to FIG. 6, it is not mentioned about whether the cathode is in a stationary state or not. However, the plating 22 can be formed regardless of the state of the cathode, such as whether the cathode is in the stationary state or in a rotating state. Although not illustrated, the plating 22 may be formed by applying voltage between the cathode and the anode, which are fixed to inner surface of a container filled with a solution, while rotating the container. The production method of the plating 22 is not particularly limited.

In the embodiment described above, the mass percentage of the carbon atoms 23 of the oxidation inhibitor molecules 24 is exemplarily 2.2. The mass percentage of the carbon atoms 23 of the oxidation inhibitor molecules 24 is at least in the range from 0.5 to 5.5.

Figure 15:
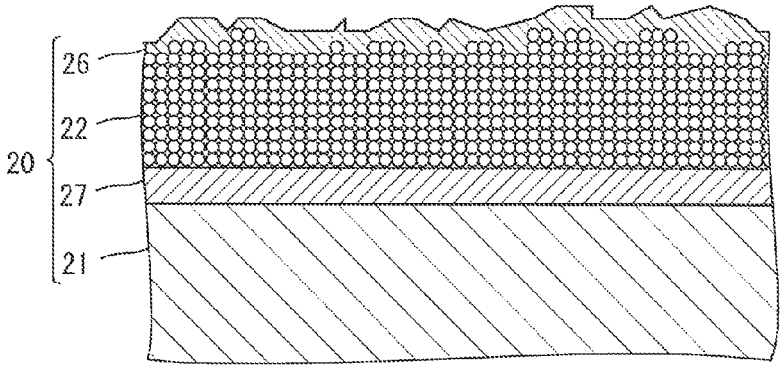
FIG. 15 is a diagram illustrating a cross-section of a surface electrode according to a modification of the embodiment.

In the embodiment described above, the base material 21 is exemplarily coated only with the plating 22. As another example, as shown in FIG. 15, the base material 21 may be coated with a surface layer plating 26, in addition to the plating 22. As further another example, the base material 21 may be also coated with a buffer 27, in addition to the plating 22. As still another example, the base material 21 may be coated with all of or any of the buffer 27, the plating 22, and the surface layer plating 26. The buffer 27 is disposed between the base material 21 and the plating 22 to firmly connect the plating 22 to the base material 21. The surface layer plating 26 is disposed above the plating 22 and directly contacts the terminal electrode 30. The plating 22 does not have metallic luster due to the oxidation inhibitor molecules 24, and the surface layer plating 26 functions to change an appearance of the surface electrode 20. For example, the buffer 27 is made of nickel, and the surface layer plating 26 is made of copper. Each of the buffer 27 and the surface layer plating 26 is thinner than the plating 22.

While only the selected exemplary embodiment and examples have been chosen to illustrate the present disclosure, it will be apparent to those skilled in the art from this disclosure that various changes and modifications can be made therein without departing from the scope of the disclosure as defined in the appended claims. Furthermore, the foregoing description of the exemplary embodiment and examples according to the present disclosure is provided for illustration only, and not for the purpose of limiting the disclosure as defined by the appended claims and their equivalents.

What is claimed is:

1. A composite material comprising:

a metal material having conductivity; and an oxidation inhibitor mixed with the metal material, the oxidation inhibitor forming a complex with the metal material, the complex of the oxidation inhibitor and the metal material having an activation energy of oxidation higher than that of a simple substance of the metal material to exert a resistance to oxidation of the metal material, wherein the metal material includes a plurality of metal atoms, the oxidation inhibitor includes a plurality of oxidation inhibitor molecules, a metal bonding between the metal atoms and a coordinate bonding between the metal atom and the oxidation inhibitor molecule are stronger than an intermolecular interaction between the oxidation inhibitor molecules, the metal atoms are bonded to form a metal mass, each of a plurality of unit components is made of the metal mass and the oxidation inhibitor molecules bonded to the metal mass, the plurality of unit components are uniformly distributed, and the oxidation inhibitor completely encapsulates the metal mass in each of the plurality of unit components to provide a constant conductivity throughout the plurality of unit components collectively.

2. The composite material according to claim 1, wherein the oxidation inhibitor includes the oxidation inhibitor molecules containing carbons atoms in a range from 0.5 to 5.5% by mass of a total mass percentage of all elements forming the metal material and the oxidation inhibitor.

3. The composite material according to claim 1, wherein the oxidation inhibitor molecules include at least one of 1,10-phenanthroline, 1,10-phenanthroline hydrochloride, thiourea, and ethylenediaminetetraacetic acid.

4. The composite material according to claim 1, wherein the metal atoms are one of copper, tin, nickel, and an alloy containing at least one of copper, tin and nickel as a main component.

5. The composite material according to claim 1, wherein the oxidation inhibitor is 1,10-phenanthroline.

6. The composite material according to claim 5, wherein the metal material is copper.

7. The composite material according to claim 1, wherein a diameter of each of the plurality of unit components in which the oxidation inhibitor completely encapsulates the metal mass is 20 nm and the diameter of the metal mass within each of the plurality of unit components is less than 20 nm.

8. An electrode comprising:

a composite material; and a base material, wherein the composite material includes a metal material having conductivity and an oxidation inhibitor mixed with the metal material, the oxidation inhibitor forming a complex with the metal material, the complex of the oxidation inhibitor and the metal material has an activation energy of oxidation higher than that of a simple substance of the metal material to exert a resistance to oxidation of the metal material, the metal material includes a plurality of metal atoms, the oxidation inhibitor includes a plurality of oxidation inhibitor molecules, a metal bonding between the metal atoms and a coordinate bonding between the metal atom and the oxidation inhibitor molecule are stronger than an intermolecular interaction between the oxidation inhibitor molecules, the metal atoms are bonded to form a metal mass, each of a plurality of unit components is made of the metal mass and the oxidation inhibitor molecules bonded to the metal mass, the plurality of unit components are uniformly distributed, the oxidation inhibitor completely encapsulates the metal mass in each of the plurality of unit components to provide a constant conductivity throughout the plurality of unit components collectively, and the composite material is disposed on a surface of the base material as a plating material.

9. The electrode according to claim 8, wherein the oxidation inhibitor is 1,10-phenanthroline, and the metal material is copper.

10. The electrode according to claim 8, wherein a diameter of each of the plurality of unit components in which the oxidation inhibitor completely encapsulates the metal mass is 20 nm and the diameter of the metal mass within each of the plurality of unit components is less than 20 nm.

11. A connection structure comprising:

a first electrode; and a second electrode, wherein a part of the second electrode is pressed against the first electrode due to a reaction force of the second electrode so that the second electrode is electrically connected to the first electrode, and at least one of the first electrode and the second electrode has a surface plated with the a composite material, wherein the composite material includes a metal material having conductivity and an oxidation inhibitor mixed with the metal material, the oxidation inhibitor forming a complex with the metal material, the complex of the oxidation inhibitor and the metal material has an activation energy of oxidation higher than that of a simple substance of the metal material thereby to exert a resistance to oxidation of the metal material, the metal material includes a plurality of metal atoms, the oxidation inhibitor includes a plurality of oxidation inhibitor molecules, a metal bonding between the metal atoms and a coordinate bonding between the metal atom and the oxidation inhibitor molecule are stronger than an intermolecular interaction between the oxidation inhibitor molecules, the metal atoms are bonded to form a metal mass, each of a plurality of unit components is made of the metal mass and the oxidation inhibitor molecules bonded to the metal mass, the plurality of unit components are uniformly distributed, and the oxidation inhibitor completely encapsulates the metal mass in each of the plurality of unit components to provide a constant conductivity throughout the plurality of unit components collectively.

12. The connection structure according to claim 11, wherein the oxidation inhibitor is 1,10-phenanthroline, and the metal material is copper.

13. The connection structure according to claim 11, wherein a diameter of each of the plurality of unit components in which the oxidation inhibitor completely encapsulates the metal mass is 20 nm and the diameter of the metal mass within each of the plurality of unit components is less than 20 nm.

* * * * *